US005108700A

United States Patent [19]

Liu

[11] Patent Number: 5,108,700

[45] Date of Patent: Apr. 28, 1992

[54] CASTABLE NICKEL ALUMINIDE ALLOYS FOR STRUCTURAL APPLICATIONS

[75] Inventor: Chain T. Liu, Oak Ridge, Tenn.

[73] Assignee: Martin Marietta Energy Systems, Inc., Oak Ridge, Tenn.

[21] Appl. No.: 397,058

[22] Filed: Aug. 21, 1989

[51] Int. Cl.[5] ..... C22C 19/05

[52] U.S. Cl. ..... 420/445; 148/410; 148/428

[58] Field of Search ..... 420/445; 148/410, 428

[56] References Cited

U.S. PATENT DOCUMENTS

| | | | |
|---|---|---|---|
| 3,620,719 | 11/1971 | Wheaton et al. | 420/449 |
| 3,890,816 | 6/1975 | Allen et al. | 420/448 |
| 4,082,581 | 4/1978 | Ghosh | 148/410 |
| 4,589,937 | 5/1986 | Jackson et al. | 148/410 |
| 4,612,165 | 9/1986 | Liu et al. | 420/459 |
| 4,711,761 | 12/1987 | Liu et al. | 420/459 |
| 4,722,828 | 2/1988 | Liu | 420/455 |
| 4,731,221 | 3/1988 | Liu | 420/445 |
| 4,781,772 | 11/1988 | Benn et al. | 148/410 |
| 4,839,140 | 6/1989 | Cathcart et al. | 420/446 |
| 4,878,965 | 11/1989 | Gostic et al. | 148/410 |

FOREIGN PATENT DOCUMENTS 2037322A 7/1980 United Kingdom .

OTHER PUBLICATIONS

Liu et al., "Development of Nickel-Iron Aluminides", Oak Ridge National Laboratory Report, Sep. 1987, 57 pages, Metals Abstracts #88-351260.

Advanced Materials and Processes, vol. 135, #2, pp. 37-41 (Feb. 1989).

K. Aoki & O. Izumi, Translation from *Nippon Kinzoku Gakkaishi*, vol. 43, #12, pp. 1190-1195, Jul. 12, 1979.

*Primary Examiner*—R. Dean

*Assistant Examiner*—David Schumaker

*Attorney, Agent, or Firm*—J. Donald Griffin; Ivan L. Ericson

[57] ABSTRACT

The specification discloses nickel aluminide alloys which include as a component from about 0.5 to about 4 at. % of one or more of the elements selected from the group consisting of molybdenum or niobium to substantially improve the mechanical properties of the alloys in the cast condition.

12 Claims, 2 Drawing Sheets

CASTABLE NICKEL ALUMINIDE ALLOYS FOR STRUCTURAL APPLICATIONS

The U.S. Government has rights in this invention pursuant to contract No. DE-AC05-A40R21400 awarded by U.S. Department of Energy contract with Martin Marietta Energy Systems, Inc.

The present invention relates to nickel aluminide alloys and more particularly relates to nickel aluminides useful for structural applications in the cast condition.

Previous developments in the properties of nickel aluminide alloys have been devoted mainly to improvement in ductility and fabricability, particularly at elevated temperatures. However, it has been found that the high temperature fabricable alloys are relatively weak in the cast condition. For example, in many applications involving the use of cast materials such as turbocharger rotors for advanced heat engines, jet engines and the like, the yield strength at room temperature is required to be above about 80 ksi. Known high temperature fabricable nickel aluminides exhibit room temperature yield strengths in the cast condition that are only marginally acceptable for these applications.

Accordingly, it is an object of the present invention to provide new and improved nickel aluminide alloys.

It is another object of the invention to provide high temperature fabricable nickel aluminide alloys which exhibit improved mechanical properties in the cast condition.

A further object of the invention is the provision of nickel aluminide alloys which exhibit a yield strength substantially above about 80 ksi in the cast condition at ambient temperatures.

The foregoing and other objects and advantages are achieved in accordance with the present invention which provides a nickel aluminide composition comprising nickel, and, in atomic percent, from about 14 to about 18% aluminum, from about 6 to about 9% chromium, from about 0.1 to about 1.5% zirconium, from about 0.015 to about 0.30% boron, and from about 0.5 to about 4% of one or more elements selected from the group consisting of molybdenum and niobium. Carbon at a level below about 0.5 wt. % can be added for control of carbide precipitation and cast grain structures. The alloys of the invention exhibit improved mechanical properties in the cast condition and, in particular, are found to exhibit yield strengths of at least about 90 ksi in the cast condition at ambient temperatures. Thus, the invention provides for the production of nickel aluminide-based materials which substantially exceed the 80 ksi room temperature yield strength required of the material in the cast condition for many important applications. A particularly preferred composition in accordance with the invention includes, in atomic percent, about 16.2% aluminum, about 8% chromium, about 1.7% molybdenum, about 0.3% zirconium, about 0.02% boron and the balance nickel.

Figure 1A:
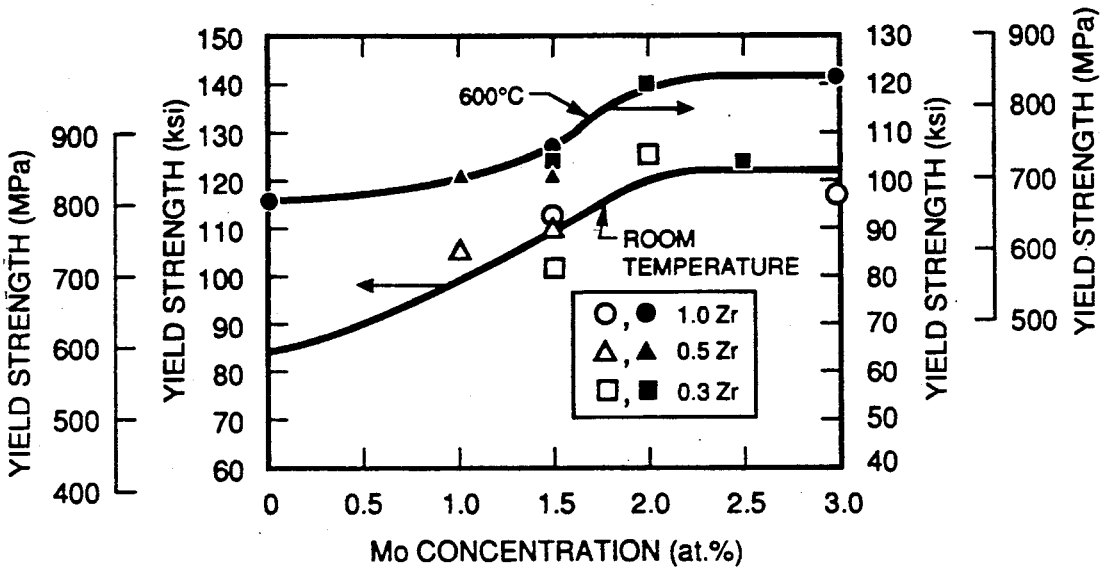
Figure 1B:
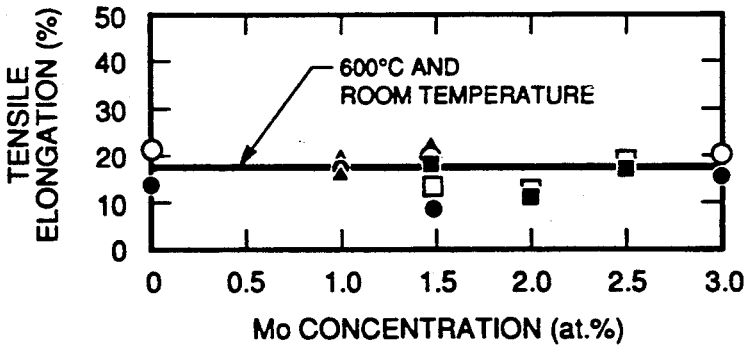
Figure 2A:
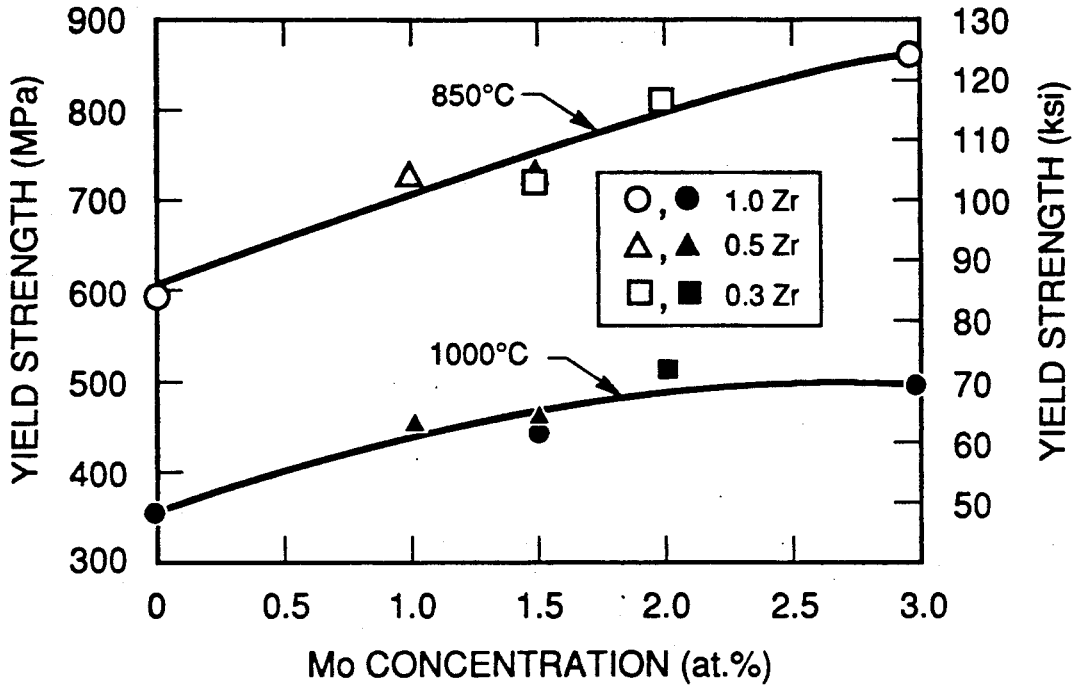
Figure 2B:
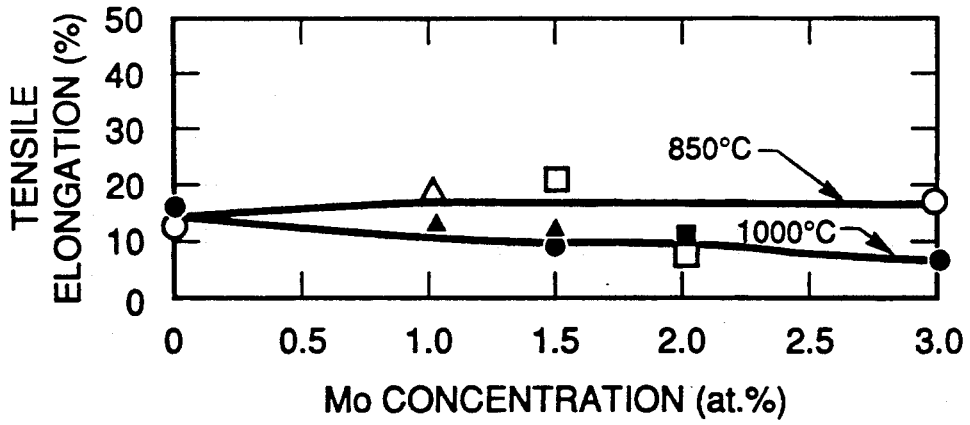

The above and other features and advantages of the invention will now be described in further detail with reference to the drawings in which:

FIGS. 1*a* and 1*b* are plots of molybdenum concentration versus yield strength and tensile elongation, respectively, as measured at ambient temperature and at 600° C. for nickel aluminide alloys in accordance with the invention containing varying amounts of zirconium; and FIGS. 2*a* and 2*b* are plots of molybdenum concentration versus yield strength and tensile elongation, respectively, as measured at 850° C. and 1,000° C. for nickel aluminide compositions in accordance with the invention and containing varying amounts of zirconium.

The compositions of the invention include nickel and aluminum to form a polycrystaline intermetallic $Ni_3Al$, chromium, zirconium and boron together with molybdenum or niobium in a concentration of from about 0.5 to about 4 at. % in order to provide nickel aluminide-based compositions exhibiting improved mechanical properties in the cast condition. The addition of up to 2 at. % titanium is also found to improve the yield strength of the compositions in the cast condition but to a lesser extent than either molybdenum or niobium, with molybdenum being a particularly preferred element for addition to the compositions for improving the tensile strength and creep resistence of the nickel aluminides in the cast condition.

The aluminum and chromium in the compositions of the invention are provided in the range of from about 14 to about 18 at. % and from about 6 to about 9 at. %, respectively. The concentration of chromium affects the ductility and strength of the alloys at room temperature and at elevated temperatures as taught in the assignee's U.S. Pat. No. 4,731,221 entitled "Nickel Aluminides and Nickel-Iron Aluminides for Use in Oxidizing Environments", the disclosure of which is incorporated herein by reference. A high chromium concentration of about 10% causes a decrease in room temperature ductility, while a low concentration of about 6% results in low ductility at 760° C. The optimum concentration of chromium is believed to be about 8 at. percent. The aluminum concentration affects the amount of ordered phase in the alloys and the optimum level of aluminum is believed to be about 16.2% in the compositions of the present invention.

Boron is included to improve the ductility of the alloys as disclosed in the assignee's U.S. Pat. No. 4,711,761 entitled "Ductile Aluminide Alloys For High Temperature Applications," the disclosure of which is incorporated herein by reference, and in an amount ranging from about 0.08 to about 0.30 at. percent. For the cast alloys, the boron level can be further reduced to about 0.015 at. percent. The optimum concentration of boron is believed to be about 0.02 at. percent.

The compositions of the invention may be prepared by arc melting and casting (other casting methods used in industry should also apply) to produce castings that exhibit significantly improved mechanical properties in the cast condition over prior art compositions through a wide range of temperatures from ambient to 1,000° C. Table 1 shows the tensile properties of the alloys of the invention in the cast condition at temperatures ranging from ambient to 1,000° C., and also includes for comparison tensile strength data of a base alloy IC-221 to which additions of molybdenum, niobium and titanium are made to produce compositions in accordance with the present invention exhibiting improved mechanical properties in the cast condition. In Table 1, it is to be noted that the base alloy IC-221 contains 16.1% aluminum, 8% chromium, 1% zirconium, 0.1% boron and the balance nickel. It is to be further noted that in the alloys of the invention listed in Table 1, the niobium and titanium are added to the base alloy in place of aluminum and that molybdenum is added to the base alloy for an equal amount of nickel and aluminum. Adjustments in the amount of zirconium are for an equal amount of aluminum. All of the alloys are prepared by arc melting and drop casting using pure metal lumps and a Ni-4 wt. % boron master alloy. The tensile specimens are electro-discharge machines directly from ingots without any heat treatments.

TABLE 1.

TENSILE PROPERTIES OF NICKEL ALUMINIDES IN THE CAST CONDITION

| Alloy No. | Alloy Comp. (at. %) | Yield Strength (ksi) | Tensile Strength (ksi) | Elongation (%) |
|---|---|---|---|---|
| | | Room temperature | | |
| IC-221 | 0.0 Mo + 1.0 Zr | 82.3 | 124.7 | 22.1 |
| IC-398 | 1.0 Mo + 0.5 Zr | 103.7 | 153.4 | 19.9 |
| -398 | 1.5 Mo + 0.3 Zr | 100.0 | 116.0 | 12.8 |
| -396 | 1.5 Mo + 0.5 Zr | 109.3 | 159.9 | 23.8 |
| -410 | 1.5 Mo + 0.5 Zr + 0.5 Nb | 120.1 | 149.0 | 10.2 |
| -390 | 1.5 Mo + 1.0 Zr | 110.7 | 161.8 | 21.3 |
| -403 | 2.0 Mo + 0.3 Zr | 124.5 | 160.4 | 11.1 |
| -404 | 2.5 Mo + 0.3 Zr | 121.9 | 180.5 | 19.4 |
| -391 | 3.0 Mo + 1.0 Zr | 117.4 | 139.1 | 20.9 |
| IC-402 | 1.0 Nb + 0.5 Zr | 111.2 | 167.6 | 18.1 |
| -400 | 1.5 Nb + 0.5 Zr | 115.0 | 185.4 | 20.7 |
| -399 | 1.5 Nb + 1.0 Zr | 101.5 | 133.5 | 9.7 |
| IC-388 | 1.5 Ti + 1.0 Zr | 108.1 | 169.2 | 17.5 |
| -389 | 3.0 Ti + 1.0 Zr | 103.1 | 150.9 | 17.2 |
| | | 600° C. | | |
| IC-221 | | 95.8 | 123.2 | 12.9 |
| IC-397 | | 100.8 | 143.5 | 19.6 |
| -398 | | 104.0 | 141.2 | 19.5 |
| -396 | | 102.1 | 149.2 | 20.7 |
| -390 | | 104.6 | 124.3 | 8.1 |
| -403 | | 119.5 | 161.3 | 10.7 |
| -404 | | 100.1 | 136.4 | 18.0 |
| -391 | | 121.0 | 162.0 | 15.7 |
| IC-402 | | 106.5 | 156.7 | 21.5 |
| -400 | | 100.8 | 150.4 | 20.2 |
| -399 | | 108.5 | 169.5 | 16.2 |
| IC-388 | | 102.7 | 122.8 | 3.8 |
| -389 | | 102.7 | 105.9 | 1.0 |
| | | 850° C. | | |
| IC-221 | | 85.5 | 104.4 | 12.1 |
| IC-397 | | 105.7 | 123.8 | 18.8 |
| -398 | | 104.3 | 116.8 | 18.7 |
| -396 | | 105.2 | 121.0 | 10.3 |
| IC-390 | | 104.8 | 124.0 | 9.1 |
| -403 | | 117.0 | 133.3 | 7.0 |
| -391 | | 125.3 | 141.0 | 14.1 |
| IC-402 | | 104.5 | 131.5 | 13.4 |
| -399 | | 105.7 | 135.6 | 11.5 |
| IC-388 | | 108.3 | 134.7 | 9.3 |
| -389 | | 104.7 | 135.1 | 6.5 |
| | | 1000° C. | | |
| IC-221 | | 51.1 | 64.0 | 12.5 |
| IC-397 | | 66.3 | 74.4 | 12.6 |
| -396 | | 67.3 | 79.2 | 10.4 |
| -390 | | 64.8 | 71.4 | 8.5 |
| -403 | | 73.9 | 80.9 | 8.6 |
| -391 | | 71.8 | 78.0 | 4.8 |
| IC-402 | | 65.8 | 77.4 | 11.4 |
| -399 | | 67.5 | 77.5 | 9.8 |
| IC-388 | | 60.9 | 72.3 | 12.3 |

The yield strength and tensile elongation data for the compositions containing molybdenum are depicted graphically in FIGS. 1 and 2 for ease of comparison. Also, for each temperature at which tests are conducted, a curve is fitted to the data from which the relationship between the molybdenum concentration and the property of interest may be more readily visualized.

It is seen from the data of Table 1 and from the figures that the as-cast yield strength for the compositions containing molybdenum increases sharply with molybdenum concentration, and that the yield strength levels off at about 2 at. % molybdenum at ambient temperature, 600° C., and 1000° C. At 850° C., the as-cast yield strength increases continuously with molybdenum additions up to the 3 at. % level. At about and above 0.5 at. % molybdenum, the room temperature yield strength in the cast condition significantly exceeds the 80 ksi level required of the product in many important applications. From this data, a range for the molybdenum of from about 0.5 to about 4.0 at. % is believed to be useful for practicing the invention to produce compositions possessing the improved mechanical properties disclosed herein.

The optimum yield strength is achieved in the cast condition for the compositions incorporating from about 1.5 to about 3 at. % molybdenum which is, therefore, a preferred range of molybdenum for use in compositions of the invention.

Table 1 and FIGS. 1(*b*) and 2(*b*) show that the compositions containing above about 0.5 at. % molybdenum exhibit a relatively constant ductility of about 15% at all test temperatures up to 850° C. and that the ductility decreases somewhat with molybdenum at 1000° C.

Table 1 also shows that niobium and titanium additions improve the yield strength of the cast compositions at all temperatures, with the niobium generally paralleling the molybdenum in terms of the yield strength improvement and the titanium improving the strength to a lesser extent than either molybdenum or niobium. The addition of both molybdenum and niobium (IC-410) also results in a significant improvement in the mechanical properties of the cast aluminides.

The tensile properties of the alloys IC-396 and IC-391 from Table 1 are reproduced in Table 2 below, together with those of one of the most widely used cast superalloys IN-713C which contains, in weight percent, 6.1% aluminum, 12.5% chromium, 4.2% molybdenum, 2% niobium, 0.8% titanium, 0.12% carbon, 0.1% zirconium, 0.012% boron, and the balance nickel.

TABLE 2.

COMPARISON OF TENSILE PROPERTIES OF MOLYBDENUM-MODIFIED NICKEL ALUMINIDES WITH THE COMMERCIAL ALIOY IN-713C

| Alloy No. | Yield Strength (ksi) | Ultimate tensile Strength (ksi) | Elongation (%) |
|---|---|---|---|
| | Room temperature | | |
| IC-396 | 109 | 160 | 23.8 |
| IC-391 | 117 | 139 | 20.9 |
| IN-713C | 107 | 128 | 8 |
| | 600° C. | | |
| IC-396 | 102 | 149 | 20.7 |
| IC-391 | 121 | 162 | 15.7 |
| IN-713C | 100 | 133 | 8 |
| | 800° C. | | |
| IC-396 | 105 | 121 | 10.3 |
| IC-391 | 125 | 141 | 14.1 |
| IN-713C | 87 | 115 | 5.0 |
| | 1000° C. | | |
| IC-396 | 67.3 | 79.2 | 10.4 |
| IC-391 | 71.8 | 78.0 | 4.8 |
| IN-713C | 34 | 53 | 12 |

It is seen from Table 2 that the alloys of the invention are considerably more ductile in the cast condition than IN-713C at temperatures up to about 850° C. and are much stronger at 1000° C.

Table 3 shows the creep properties of selected alloys of the invention from Table 1. Table 3 also includes for comparison the creep properties of the composition containing no alloy additions, and of the commercial cast alloy IN-713C and the wrought superalloy known as WASPALOY which contains, in weight percent, 19.5% chromium, 13.5% cobalt, 4.25% molybdenum, 3% titanium, 2% iron, 1.3% aluminum, 0.1% carbon, 0.085% zirconium, 0.005% boron, and the balance nickel.

TABLE 3.

CREEP PROPERTIES OF CAST ALUMNIDE ALLOYS AND COMMERCIAL ALLOYS WASPALOY AND IN-713C

| Alloy No. | Alloy Comp. (at. %) | Creep rate (%/h) | Time for 1% Creep (h) | Test Time (h) | Rupture Time (h) |
|---|---|---|---|---|---|
| IC-221 | 0.0 Mo + 1.0 Zr | $5.8 \times 10^{-3}$ | 150 | 957 | N/A |
| -398 | 1.5 Mo + 0.3 Zr | $1.1 \times 10^{-3}$ | 720 | 400 | N/A |
| -396 | 1.5 Mo + 0.5 Zr | $1.7 \times 10^{-3}$ | 422 | 390 | N/A |
| -403 | 2.0 Mo + 0.3 Zr | $1.5 \times 10^{-3}$ | 533 | 305 | N/A |
| -391 | 3.0 Mo + 1.0 Zr | $5.8 \times 10^{-4}$ | 1550 | 381 | N/A |
| -400 | 1.5 Nb + 0.5 Zr | $1.6 \times 10^{-3}$ | 538 | 301 | N/A |
| -388 | 1.5 Ti + 1.0 Zr | $4.6 \times 10^{-3}$ | 165 | 250 | N/A |
| Waspaloy | | N/A | N/A | N/A | 100 |
| IN-713C | | $\approx 2 \times 10^{-3}$ | N/A | N/A | 1300 |

The results of Table 3 show that the molybdenum and niobium additions substantially reduce the creep rate relative to the compositions containing no alloy additions and that these additions extend the time for 1% creep strain, resulting in considerably improved creep resistance for the alloys in the cast condition. Table 3 also indicates that the creep properties of the alloys of the invention are better than those of the commercial superalloy WASPALOY and are comparable to the cast superalloy IN-713C.

The oxidation properties of selected cast alloys from Table 1 were determined in air at 800° C. and 1000° C. In these tests, alloy coupons were oxidized for one to three days in air, cooled to room temperature, and the weight change was measured. Table 4 summarizes the oxidation properties of the alloys with 1.5 at. % molybdenum, niobium and titanium, together with the base alloy IC-221 containing no alloy additions.

TABLE 4.

AIR OXIDATION PROPERTIES OF NICKEL ALUMINIDES MODIFIED WITH 1.5 at. % Mo, Nb and Ti

| Alloy No. | Comp. (at. %) | Exposure Temp./Time (°C.) (h) | Weight Gain (mg/cm²) | Remarks |
|---|---|---|---|---|
| IC-221 | 0.0 Mo + 1.0 Zr | 1000 500 | 2.34 | No spalling |
| -396 | 1.5 Mo + 0.5 Zr | 1000 500 | 1.31 | No spalling |
| -400 | 1.5 Nb + 0.5 Zr | 1000 500 | 1.48 | No spalling |
| -388 | 1.5 Ti + 1.0 Zr | 1000 500 | 2.95 | No spalling |
| IC-221 | 0.0 Mo + 1.0 Zr | 800 500 | 0.23 | No spalling |
| -396 | 1.5 Mo + 0.5 Zr | 800 500 | 0.22 | No spalling |
| -400 | 1.5 Nb + 0.5 Zr | 800 500 | 0.21 | No spalling |
| -388 | 1.5 Ti + 1.0 Zr | 800 500 | 0.28 | No spalling |

From Table 4 it is seen that all alloys show no spalling and that the alloys exhibit excellent oxidation resistance. Alloying with molybdenum and niobium slightly lowers the oxidation rate of the base alloys, while alloying with titanium slightly increases the rate at both temperatures.

Overall, the alloy IC-396 appears to have near the optimum composition in terms of the mechanical properties that are exhibited for the product in the cast condition. In order to study the effect of minor changes in the composition, a number of alloys based on IC-396 were prepared in which the concentrations of zirconium, molybdenum, boron, and carbon were slightly adjusted. Table 5 shows the tensile data of some of these adjusted alloys.

TABLE 5.

TENSILE PROPERTIES OF CAST NICKEL ALUMINIDES BASED ON IC-396[1]

| Alloy No. | Yield strength (ksi) | Tensile strength (ksi) | Elongation (%) |
|---|---|---|---|
| Room Temperature | | | |
| IC-396[1] | 109 | 160 | 23.8 |
| IC-412[2] | 102 | 154 | 20.9 |
| IC-396M[3] | 100 | 159 | 26.2 |
| IC-396C[4] | 105 | 161 | 23.2 |
| 600° C. | | | |
| IC-396[1] | 102 | 149 | 20.7 |
| IC-412[2] | 99 | 139 | 22.2 |
| IC-396M[3] | 97 | 141 | 26.5 |
| IC-396C[4] | 101 | 125 | 13.3 |
| 850° C. | | | |
| IC-396 | 105 | 121 | 10.3 |
| IC-412 | 106 | 121 | 6.9 |
| IC-396M | 108 | 123 | 11.8 |
| IC-396C | 110 | 123 | 4.2 |
| 1000° C. | | | |
| IC-396 | 67.3 | 79.2 | 10.4 |
| IC-412 | 60.3 | 71.5 | 8.9 |
| IC-396M | 66.1 | 72.6 | 7.1 |
| IC-396C | 58.7 | 72.1 | 7.4 |

[1]Base composition in at. percent: 16.4% aluminum, 8.0% chromium, 1.5% molybdenum, 0.50% zirconium, 0.15% boron, and the balance nickel.
[2]Low zirconium modification in at. percent: 16.1% aluminum, 8.0% chromium, 1.7% molybdenum, 0.25% zirconium, 0.15% boron, and the balance nickel.
[3]Low boron modification in at. percent: 16.0% aluminum, 8.0% chromium, 1.7% molybdenum, 0.50% zirconium, 0.025% boron, and the balance nickel.
[4]Carbon modification in at. percent: 15.9% aluminum, 8.5% chromium, 1.7% molybdenum, 0.50% zirconium, 0.025% boron, 0.20% carbon, and the balance nickel.

In general, the tensile properties of IC-396 are not very sensitive to the above-described minor adjustments in the composition. A decrease in zirconium from 0.5 at. % (IC-396) to 0.25 at. % (IC-412) appears to cause only a small decrease in yield strength at 1000° C. A reduction in boron from 0.15 at. % (IC-396) to 0.025 at. % (IC-396M) results in a small increase in ductility at room temperature, 600° and 850° C. The carbon was added to control carbide precipitation and cast grain structure. As shown in Table 5, the addition of 0.20 at. % carbon appears to lower the ductility somewhat at 600° and 850° C.

It is thus seen from the foregoing that the mechanical properties including the tensile strength and creep resistance of nickel aluminides in the cast condition are substantially improved by alloying with from about 0.5 to about 4% molybdenum and niobium and that the addition of up to about 2 at. % titanium results in similar improvement in the mechanical properties of the aluminides. The room temperature yield strength of the alloys in the cast condition is well above the 80 ksi minimum required for cast components in advanced heat engines, jet engines, and various energy conservation systems. As a result, the potential uses for nickel aluminide compositions in the cast condition are expanded so that the beneficial high temperature properties of the aluminides may be realized in a wider range of applications.

Although preferred embodiments of the invention have been described in the foregoing detailed description, it will be understood that the invention is capable of numerous rearrangements, substitutions, modifications and the like without departing from the scope and spirit of the following claims.

What is claimed is:

1. A nickel aluminide composition consisting essentially of nickel and, in at. %, from about 14 to about 18% aluminum, from about 6 to about 9% chromium, from about 0.1 to about 1.5% zirconium, from about 0.015 to about 0.3% boron, and from about 0.5 to about 4% of one or more elements selected from the group consisting of molybdenum and niobium.

2. The composition of claim 1 wherein the element selected from said group is molybdenum.

3. The composition of claim 2 wherein the molybdenum concentration is from about 1.5 to about 3 percent.

4. The composition of claim 1, wherein the aluminum concentration is about 16.2%, the chromium concentration is about 8%, the element that is selected from said group is molybdenum in a concentration of about 1.7%, the zirconium concentration is about 0.3%, and the boron concentration is about 0.02%.

5. The composition of claim 1, wherein the element selected from said group is niobium and the concentration of niobium is about 1.5%.

6. The composition of claim 1 further comprising from about 0.001 to about 0.5 at. % carbon.

7. A nickel aluminide composition consisting essentially of, in at. %, from about 14 to about 18% aluminum, from about 6 to about 9% chromium, from about 0.5 to about 4% of one or more elements selected from the group consisting of molybdenum and niobium, from about 0.1 to about 1.5% zirconium, from about 0.015 to about 0.3% boron, and the balance nickel, wherein the composition exhibits a room temperature yield strength greater than about 80 ksi in the as-cast condition.

8. The composition of claim 7 wherein, the aluminum concentration is about 16.2%, the chromium concentration is about 8%, the element selected from said group is molybdenum in a concentration of about 1.7%, the zirconium concentration is about 0.3%, and the boron concentration is about 0.02%.

9. A nickel aluminide composition consisting essentially of nickel and, in at. %, from about 14 to about 18% aluminum, from about 6 to about 9% chromium, from about 0.1 to about 1.5% zirconium, from about 0.015 to about 0.3% boron, and from about 0.5 to about 4% of one or more elements selected from the group consisting of molybdenum, niobium, and titanium.

10. The method of producing nickel aluminide compositions for use in the cast condition which comprises casting a composition consisting essentially of nickel and, in at. %, from about 14 to about 18% aluminum, from about 6 to about 9% chromium, from about 0.1 to about 1.5% zirconium, from about 0.015 to about 0.3% boron, and from about 0.5 to about 4% of one or more elements selected from the group consisting of molybdenum and niobium, wherein the resulting composition exhibits a room temperature yield strength greater than about 80 ksi in the cast condition.

11. The nickel aluminide composition of claim 1 wherein said composition exhibits a room temperature yield strength greater than about 80 ksi in the cast condition.

12. The nickel aluminide composition of claim 1 wherein said composition exhibits a room temperature yield strength of at least about 90 ksi in the as-cast condition.

* * * * *